US010036594B2

(12) United States Patent
Reali et al.

(10) Patent No.: US 10,036,594 B2
(45) Date of Patent: Jul. 31, 2018

(54) APPARATUS FOR CLOSING THE SLAG DOORWAY AND FOR CLEANING THE SLAG DOORWAY AND CHANNEL OF A METALLURGICAL FURNACE AND RELATIVE METHOD

(71) Applicant: TENOVA S.P.A., Milan (IT)

(72) Inventors: Silvio Maria Reali, Milan (IT); Mauro Grioni, Colturano (IT); Giancarlo Cavallini, Monza (IT)

(73) Assignee: TENOVA S.p.A., Milan (IT)

( * ) Notice: Subject to any disclaimer, the term of this patent is extended or adjusted under 35 U.S.C. 154(b) by 849 days.

(21) Appl. No.: 14/390,122

(22) PCT Filed: Mar. 27, 2013

(86) PCT No.: PCT/IB2013/052465

§ 371 (c)(1),
(2) Date: Oct. 2, 2014

(87) PCT Pub. No.: WO2013/150421

PCT Pub. Date: Oct. 10, 2013

(65) Prior Publication Data

US 2015/0055673 A1 Feb. 26, 2015

(30) Foreign Application Priority Data

Apr. 2, 2012 (IT) ..... MI2012A0532

(51) Int. Cl.
*F27D 1/00* (2006.01)
*F27D 3/00* (2006.01)
(Continued)

(52) U.S. Cl.
CPC ..... *F27D 1/1858* (2013.01); *F27D 3/1509* (2013.01); *F27D 3/1536* (2013.01); *F27D 25/001* (2013.01); *C21B 7/14* (2013.01)

(58) Field of Classification Search
CPC . F27D 1/18; F27D 1/1858; F27D 3/14; F27D 3/15; F27D 3/159; F27D 3/1509;
(Continued)

(56) References Cited

U.S. PATENT DOCUMENTS

2007/0290420 A1* 12/2007 Wunsche ..... F27B 3/19 266/271
2011/0038391 A1 2/2011 Miani et al.
2012/0139170 A1* 6/2012 Ki ..... F27B 3/08 266/200

FOREIGN PATENT DOCUMENTS

DE 199 16 368 A1 10/2000
WO WO 2010/094584 A1 8/2010

OTHER PUBLICATIONS

International Search Report and Written Opinion dated Jul. 25, 2013 in PCT/IB2013/052465.

* cited by examiner

*Primary Examiner* — Hung D Nguyen
(74) *Attorney, Agent, or Firm* — Oblon, McClelland, Maier & Neustadt, L.L.P.

(57) ABSTRACT

A method and apparatus closing a slag doorway and cleaning the slag doorway and channel of a metallurgical furnace including walls defining a slag doorway and a slag channel that crosses the slag doorway and has a bottom. The apparatus includes a support structure associable with the furnace, at least one slag-breaking body including a lower border that, under mounting conditions of the apparatus on the furnace, is directed towards the bottom and at a definable height, the slag-breaking body being associated with the support structure in a movable manner along the slag channel away and/or towards the slag doorway to wipe, with its lower border, the bottom or a parallel plane, and a vibrating or oscillating mechanism associated with the slag-
(Continued)

breaking body to confer a vibrating or oscillating movement with non null component incident the bottom, during a travel performed during its movement away or towards the slag doorway.

23 Claims, 13 Drawing Sheets

(51) Int. Cl.

| | |
|---|---|
| ***F27D 1/18*** | (2006.01) |
| ***F27D 3/15*** | (2006.01) |
| ***F27D 25/00*** | (2010.01) |
| *C21B 7/14* | (2006.01) |

(58) Field of Classification Search
CPC .... F27D 3/1536; F27D 3/1545; F27D 25/001; F27B 3/08; F27B 3/085; F27B 3/10; F27B 3/19; F27B 3/105; C21B 7/14
USPC ..... 373/71, 72, 75, 76, 79, 84, 60; 266/135, 266/200, 271, 272, 45; 432/237, 250
See application file for complete search history.

APPARATUS FOR CLOSING THE SLAG DOORWAY AND FOR CLEANING THE SLAG DOORWAY AND CHANNEL OF A METALLURGICAL FURNACE AND RELATIVE METHOD

The present invention refers to an apparatus for closing the slag doorway and for cleaning the slag doorway and channel of a metallurgical furnace and to the relative method.

As known, metallurgical furnaces used, for example, for steelmaking from scrap and, among these, in particular, electric arc furnaces (EAF) are equipped with a slag doorway used both to carry out the actual slagging operations, i.e. the operations of evacuating the slag through tilting of the furnace, and for operations of addition of additive material useful for the working of the furnace, and for operations of controlling and inspecting the operating conditions of the furnace (drawing of samples of the molten metal, temperature measurements or visual inspections).

Generally, the slag doorway consists of an opening formed in the side walls of the shell of the furnace to place the inside of the furnace in communication with the outside of the furnace through a slag channel coated with a coating made from refractory material.

Metallurgical furnaces are also provided with a closure panel of the slag doorway that is mobile between a closure position of the doorway to carry out the loading operations of the material to be melted and for melting the loaded material and an opening position thereof to carry out the operations of slagging, injection of additive and control/inspection.

During the working operations of the furnace, the material to be melted loaded inside the furnace tends to accumulate on the threshold of the slag doorway and also on the bottom of the slag channel.

After the slagging operations, moreover, a fraction of the slag tends to cool down and solidify on the threshold of the slag doorway and on the bottom of the slag channel forming an incrustation that may even be thick.

These accumulations and incrustations hinder the correct working and closing of the furnace in subsequent melting cycles.

It is thus necessary to carry out periodic cleaning operations of the doorway and of the slag channel to remove accumulations of material and incrustations of slag from them.

For this purpose, it is known to use separate equipment of the pushing machine type as described for example in U.S. Pat. No. 5,538,226.

Alternatively, there are known apparatuses for closing the slag doorway which, during the loading operations of the material to be melted and during the melting operations of the loaded material, block the slag doorway so as to avoid the formation of accumulations and incrustations at it and which are equipped with at least one element, in the form of a panel, arm or blade, which, as well as helping to block the doorway itself, acts as a cleaning element of the slag channel, as described for example in WO-2007/147248-A1 or in WO-2010/094584.

Such a cleaning element carries out the removal of accumulations and incrustations present in the slag channel scraping its bottom with a so-called "dredging" movement or, in any case sliding.

The action exerted by such a cleaning element on the bottom of the channel is essentially sliding and is parallel and tangent to the bottom of the slag channel.

Such an action is often insufficient to eliminate accumulations and incrustations adherent to the slag channel or wedged in the geometric irregularities of the slag channel and in the gaps of the refractory material that coats it.

Such an action also tends to demolish the coating of refractory material that covers the slag channel until it causes the detachment of the bricks themselves. Therefore, it becomes necessary to make periodic interventions for maintenance and remaking the refractory coating that covers the slag channel, with consequent long stop times of the furnace itself and disadvantageous losses of productivity.

Such known closing apparatuses also have a particularly complex, heavy and bulky structure, having to withstand the pushing reactions exerted by the cleaning element on the material to be removed.

The structure of the furnace must also be suitably reinforced to support both the weight of the cleaning element, which is considerable since it has to withstand the reactions of the push exerted on the material to be removed, and the pushing and sliding actions exerted by the cleaning element itself.

Such restructuring, as well as being burdensome, can alter the functionality of the furnace itself.

In known closing apparatuses, moreover, the actuation of the cleaning elements in sliding movement on the bottom of the slag channel so that they exert a sufficient action to remove the accumulations of material requires the use of high-power actuators with consequent wastage of energy and economic burdens.

The purpose of the present invention is to avoid the drawbacks of the prior art.

In this general purpose, a particular purpose of the present invention is to provide an apparatus for closing the slag doorway and for cleaning the slag doorway and channel of a metallurgical furnace that effectively blocks the slag doorway during the loading and working operations of the metallurgical furnace and that makes it possible to eliminate from the doorway and from the slag channel accumulations and incrustations of material in an effective and complete manner.

A further purpose of the present invention is to provide an apparatus for closing the slag doorway and for cleaning the slag doorway and channel of a metallurgical furnace that makes it possible to carry out the cleaning operations of the slag doorway and channel in a simple manner and in a short time, preserving the integrity of the coating of refractory material that covers the threshold and bottom thereof.

Yet another purpose of the present invention is to provide an apparatus for closing the slag doorway and for cleaning the slag doorway and channel of a metallurgical furnace with a relatively simple structure and with low weight and cost and that can easily be installed in known furnaces without requiring particular interventions to restructure and reinforce them.

Yet another purpose of the present invention is to provide a method for cleaning the slag doorway and channel of a metallurgical furnace that is particularly simple, effective and able to be carried out in short time periods and that makes it possible to eliminate any accumulation and incrustation of material, preserving the integrity of the refractory coating that covers the threshold of the doorway and the bottom of the slag channel.

These and other purposes according to the present invention are accomplished by making an apparatus for closing the slag doorway and for cleaning the slag doorway and channel of a metallurgical furnace.

These and other purposes according to the present invention are accomplished by making a metallurgical furnace.

These and other purposes of the present invention are also accomplished with a method for cleaning the slag doorway and channel of a metallurgical furnace.

Further characteristics are provided in the dependent claims.

The characteristics and advantages of an apparatus for closing the slag doorway and for cleaning the slag doorway and channel of a metallurgical furnace and of a method for cleaning the slag doorway and channel of a metallurgical furnace according to the present invention will become clearer from the following description, given as an example and not for limiting purposes, referring to the attached schematic drawings, in which.

Figure 11:
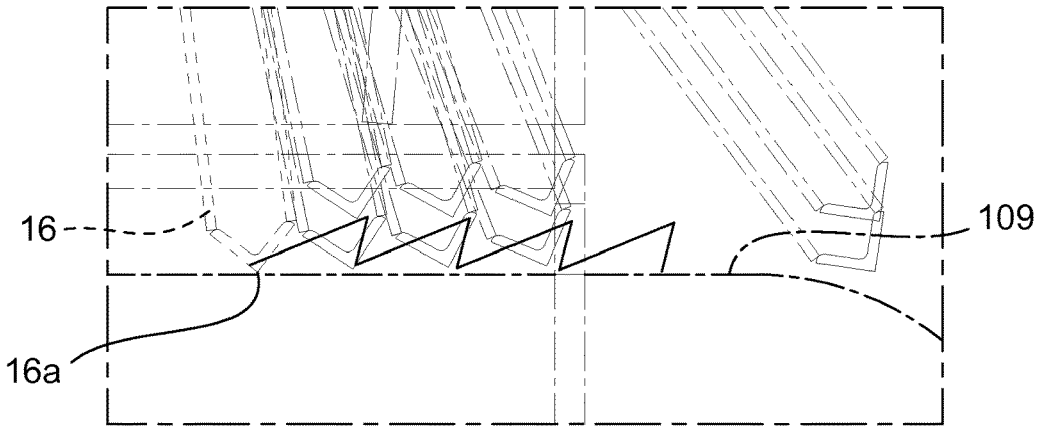
Figure 12A:
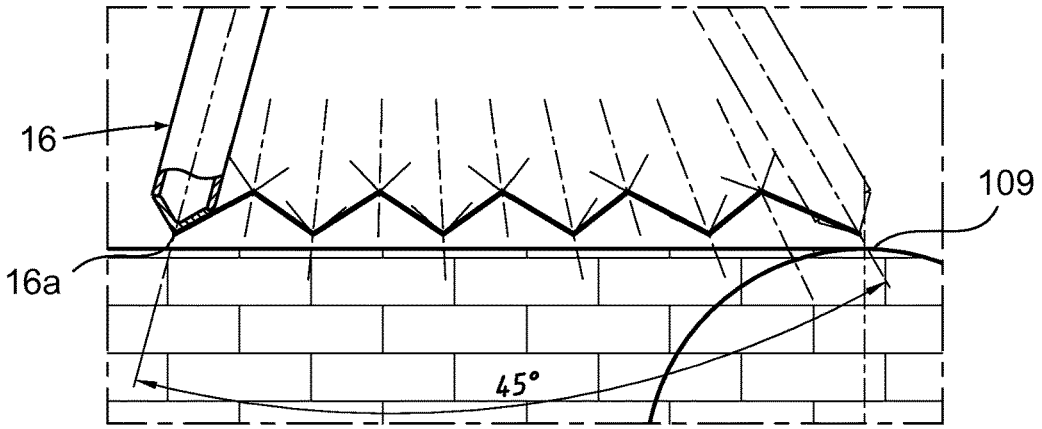
Figure 12B:
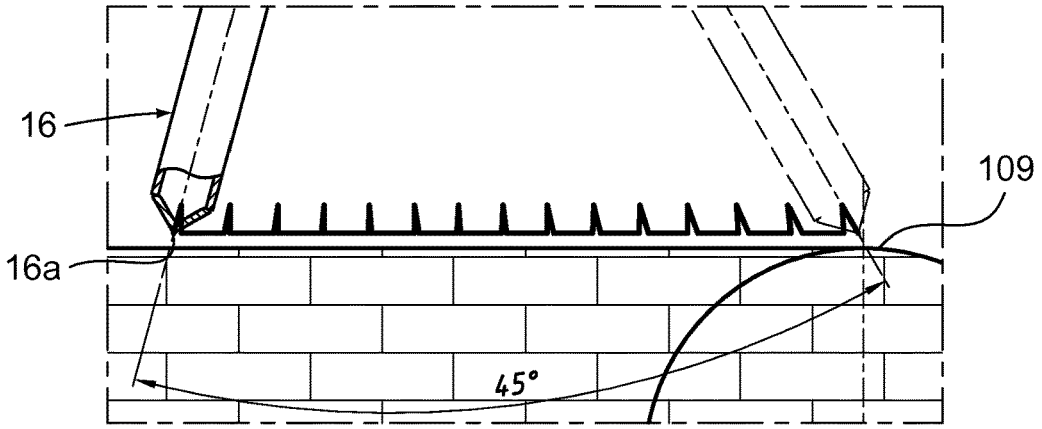

FIGS. 10A to 10E schematically show the closing and cleaning apparatus according to the present invention in some successive steps of the method for cleaning the slag doorway and channel of a metallurgical furnace according to the present invention;

FIGS. 11, 12A and 12B schematically show different possible trajectories followed by the lower border of the closure panel of the closing and cleaning apparatus according to the present invention in a cleaning cycle of the slag doorway and channel of a metallurgical furnace.

With reference to the attached figures, an apparatus 10 for closing and cleaning the slag doorway and channel of a metallurgical furnace is shown applied to a furnace 100 of the electric arc furnace (EAF) type for producing steel.

The furnace 100 is only schematically and partially illustrated, being of the type known to the man skilled in the art.

The furnace 100 comprises a shell in turn formed by a lower shell 101 and by an upper shell 102 fixed together to form a single body.

The lower shell 101 consists of a metallic structure 103 internally coated with refractory material 104 and it is intended to contain, during operation of the furnace 100, the material being melted and the slag.

The upper shell 102 consists of a metallic cage that houses panels and tube bundles 105 cooled with water.

The upper shell 102 is closed on top by a roof 106 that is removable in order to be able to carry out the loading operations of the material to be melted and that is crossed by the electrodes necessary for creating the electric arc, by evacuation ducts of the fumes and by service ducts.

On the side walls of the shell there is a slag doorway consisting in practice of an opening 107.

The opening 107 is crossed by a slag channel 108 which defines its threshold, i.e. the lower border, and which extends through the walls of the shell to place the room inside the furnace 100 in communication with the room outside the furnace 100.

The slag channel 108 is also coated with refractory material and has a bottom 109 that is defined at a lower height with respect to the height of the lower shell 101.

As known, the opening 107 (slag doorway) and the slag channel 108 indeed allow the slagging operations, i.e. the evacuation of the slag from the molten bath.

The opening 107 is also used to insert additives into the furnace 100 by means of special lances, for visual and probe-aided inspection and control operations.

The apparatus 10 comprises a support structure 11 able to be constrained to the shell of the furnace 100 and/or partially consisting of the support structure of the same shell.

For the sake of clarity of explanation, a reference system of cartesian axes defined with the origin O inside the furnace 100, the axis X parallel to the longitudinal axis of the bottom 109, the axis Z parallel to the bottom 109 and the axis Y perpendicular to the bottom 109, as schematically indicated in the figures, is set.

The support structure 11 has at least one slag-breaking body associated with it, said slag-breaking body being provided with a lower border that, under mounting conditions of the apparatus 10 on the furnace 100, is directed towards the bottom 109 and at a definable height with respect to it.

As will become clearer hereafter, in the embodiment represented in the attached figures, the slag-breaking body coincides with the closure panel of the slag doorway, or rather with its lower border; this does not rule out alternative embodiments in which the slag-breaking body consists of an element that is separate from the closure panel.

In particular, the slag-breaking body is associated with the support structure 11 in a movable manner along the slag channel 108 away from and/or towards the opening 107 (slag doorway) in order to wipe, with its lower border, the bottom 109 or a plane parallel to it.

The slag-breaking body has vibrating or oscillating means associated with it, said vibrating or oscillating means being suitable for conferring the slag-breaking body a vibrating or oscillating movement with non null component incident the bottom 109 during at least one tract of the travel made by it during its movement away from or towards the opening 107 (slag doorway). Thanks to such vibrating or oscillating movement the slag-breaking body breaks or at least weakens the layer of material to be removed present on the bottom 109.

The slag-breaking body is associated with the support structure 11 in a movable manner along a direction incident the bottom 109 to adjust the height at which its lower border is situated with respect to the bottom 109 itself.

The slag-breaking body is also associated with the support structure 11 so that during the movement away from and/or towards the opening 107 (slag doorway), its lower border follows, for at least one tract of its travel, a trajectory incident the plane defined by the opening 107 (slag doorway) and parallel to the bottom 109.

The apparatus 10 also comprises a removing body of the material that has been broken or in any case weakened by the slag-breaking body which is present on the bottom 109.

Such a removing body is provided with a lower border that, under mounting conditions of the apparatus 10 on the furnace 100, is directed towards the bottom 109 and that is placed at a definable height with respect to it.

The removing body is associated with the support structure 11 in a movable manner along the slag channel 108 away from or towards the opening 107 (slag doorway) to wipe the bottom 109 or a plane parallel to it.

As will become clearer hereafter, in the embodiment represented in the attached figures the removing body coincides with the slag-breaking body and they both coincide with and consist of the closure panel of the opening 107 (slag doorway), or rather its lower border. However, alternative embodiments are not ruled out, in which the removing body consists of a body distinct from the slag-breaking body and they are both distinct from the closure panel, or in which the removing body coincides with the closure panel of the slag doorway, or rather with its lower border, and the slag-breaking body consists of a body distinct from the latter, or furthermore in which the slag-breaking body coincides with the closure panel of the slag doorway, or rather with its lower border, and the removing body consists of a distinct body.

As indicated above, in the embodiment represented in the attached figures, the slag-breaking body and the removing body coincide with one another and consist of the panel 16 for closing the opening 107 (slag doorway) or rather its lower border 16*a*.

The panel 16 is associated with the support structure 11 in a movable manner between a closure position of the opening 107 (slag doorway) and an opening position of the slag doorway and vice-versa; under mounting conditions of the apparatus 10 on the furnace 100, the lower border 16*a* of the panel 16 is directed towards the bottom 109.

In greater detail, the support structure 11 has rectilinear guide means associated with it, said rectilinear guide means extending along a direction of line A incident the bottom 109 of the slag channel 108 and inclined with positive gradient of an angle $\alpha$ with respect to it in the system of cartesian axes XYZ defined above.

In the embodiment represented in the attached figures, such rectilinear guide means comprise a pair of rectilinear guides 12 placed at the sides of the opening 107 and outside of it.

Along the rectilinear guides 12 slide means 13 are slidably mounted the sliding movement of which is determined by first actuator means 14 associated with the support structure 11.

In the embodiment represented in the attached figures, the first actuator means 14 comprise a pair of first hydraulic cylinders 15 placed at the outer sides of the rectilinear guides 12 and each of which extends in a direction substantially parallel to the direction A. Each first hydraulic cylinder 15 has the upper end 15*a* (defined by the cylinder) articulated to the support structure 11 and the lower end 15*b* (defined by the stem) articulated to the slide means 13.

The slide means 13 have the at least one closure panel 16 of the opening 107 associated with them.

The closure panel 16 has a lower border 16*a* facing towards the threshold of the slag doorway and the bottom 109 of the slag channel 108.

Such a lower border 16*a*, as will become clearer from the following description, is shaped with a sharp profile, not represented in detail in the attached figures, to facilitate the breaking of the material that accumulates on the bottom 109. The closure panel 16, indeed, or rather its lower border 16*a*, also acts as slag-breaking body and as removing body of the broken or in any case weakened slag.

The closure panel 16 is cooled with water or another cooling fluid by means of a circulation system not depicted in detail, since it can easily be understood by the man skilled in the art.

The closure panel 16 is movable, by means of the slide means 13 moved by the first actuator means 14, between a closure position and an opening position of the slag doorway, passing through a plurality of intermediate positions. In the closure position of the slag doorway (FIGS. 1A and 8), the closure panel 16 is lowered with its lower border 16*a* substantially in contact with the threshold of the slag doorway or with the bottom 109. In the opening position of the slag doorway (FIGS. 1B and 9), the closure panel 16 is raised with respect to the threshold of the slag doorway or to the bottom 109 to leave the opening 107 pervious.

Advantageously, the closure panel 16 has a greater surface extension than that of the opening 107 so as to be able to completely block it by itself; in other words, it constitutes a unique closing element of the entire slag doorway (opening 107).

In a preferred embodiment, moreover, the closure panel 16 lies on a plane, which is indicated by the line P in the attached figures, which, considering the system of cartesian axes XYZ defined above, is inclined with negative gradient of an angle $\beta$ with respect to the bottom 109 of the slag channel 108.

Advantageously, the angle $\beta$ varies between 0° and 40°, preferably not zero.

The closure panel 16 is associated with the slide means 13 in a movable manner away from the plane defined by the slag doorway, i.e. by the opening 107, towards the outside of the furnace 100 and vice-versa, to wipe, with its lower border 16*a*, the bottom 109 of the slag channel 108 or a plane parallel to it.

In particular, the closure panel 16 is associated with the slide means 13 in a movable manner between a first position, in which the lower border 16*a* thereof is at or in any case close to the slag doorway, i.e. the opening 107, and a second position, in which the lower border 16*a* thereof is distanced from the slag doorway, i.e. the opening 107, by a definable distance D towards the outside of the furnace 100 (FIG. 10E), and vice-versa.

The closure panel 16 passes from the first to the second position and vice-versa through a plurality of intermediate positions, in which its lower border 16*a* follows, for at least one tract of its travel, a trajectory incident the plane defined by the slag doorway, i.e. by the opening 107, and parallel to the bottom 109 of the slag channel 108 and, in particular, parallel to the longitudinal axis of the slag channel 108.

The movement of the closure panel 16 between the first position and the second position and vice-versa is determined by second actuator means 17.

In the embodiment represented in the attached figures, the closure panel 16 is associated in a movable manner with the slide means 13 with possibility of combined rotation and translation movement between the first position and the second position.

In particular, there is an articulation body 18 that is articulated to the slide means 13 in a rotary manner about an axis B parallel to the bottom 109 of the slag channel 108 and to the plane of the slag doorway, perpendicular to the longitudinal axis of the slag channel 108 and defined by a cylindrical coupling 19.

The articulation body 18 has rectilinear guides 20 incident the bottom 109 of the slag channel and perpendicular to the axis B.

The closure panel 16 is mounted in a sliding manner along the rectilinear guides 20 by means of sliding coupling means consisting of one or more sliding blocks 21.

The closure panel 16 is also provided with a cam-follower pair or pins 22 coaxial to one another and parallel to the axis B and that are defined projecting from the outer sides of the closure panel 16.

Each of the two pins 22 is inserted in a sliding manner in a corresponding cam or shaped guide 23 formed in a corresponding appendage of the slide means 13.

Such a shaped guide 23 has an arched profile with concavity facing towards the bottom 109.

The second actuator means 17 are supported by the slide means 13 and comprise at least one second hydraulic cylinder 24 the cylinder 24*a* of which is fixed to the slide means 13 and the stem 24*b* of which has the end outside the cylinder 24*a* articulated to the articulation body 18.

The extension and retraction of the stem 24*b* generate a rotation of the articulation body 18 respectively in the clockwise F and anti-clockwise G direction with reference to the attached figures, and with it of the closure panel 16, about the axis B, whereas the guide system consisting of the rectilinear guides 20 and the shaped guides 23 forces the closure panel 16 to move between the first and the second position.

During such movement, the lower border 16*a* of the closure panel 16 follows, for at least one tract of its travel, a trajectory incident the plane defined by the slag doorway, i.e. by the opening 107, and parallel to the bottom 109 of the slag channel and, in particular, parallel to the axis or in any case to the longitudinal extension of the latter.

This does not rule out alternative embodiments of the articulation and/or guide means of the closure panel 16 with respect to the slide means 13; for example, they could be of the articulated quadrilateral or pantograph type.

As already indicated above, according to a special characteristic of the present invention, the apparatus 10 comprises vibrating or oscillating means 25 of the closure panel 16, i.e. of the slag-breaking body integrated in it, suitable for imposing a vibrating or oscillating movement onto it with non null component incident the bottom 109 of the slag channel 108, during at least one tract of its travel away from or towards the slag doorway or opening 107.

In particular, the vibrating or oscillating means 25 of the closure panel 16 are suitable for imposing a vibrating or oscillating movement onto it with non null component incident the bottom 109 of the slag channel 108, during at least one portion of the trajectory followed by its lower border 16*a* and as defined above.

In the embodiment represented in the attached figures, such vibrating or oscillating means 25 comprise the first actuator means 14 that are controlled by an operating and control system, not shown since it can easily be understood by the man skilled in the art, to impose an alternate movement having determined and modifiable frequency and magnitude onto the slide means 13, and onto the closure panel 16 integral in translation with them along the rectilinear guides 12. In the accompanying figures, therefore, the reference number 25, which identifies the vibrating or oscillating means, is made to coincide with the reference number 14, which identifies the first actuator means.

However, alternative embodiments of the vibrating or oscillating means 25 are not ruled out, which for example, could consist of electromechanical or electromagnetic exciters placed inside the panel 16 itself preferably close to its lower border 16*a* that actually integrates the slag-breaking body. This alternative embodiment has the advantage of concentrating the vibration or oscillation stresses close to the lower border 16*a* that actually integrates the slag-breaking body preventing them from propagating and dispersing in the entire structure of the door and thus allowing a further reduction of the weight of the closing apparatus.

When the vibrating or oscillating means 25 are activated at the same time as the second actuator means 17, the lower border 16*a* of the closure panel 16 (slag-breaking body) follows a trajectory with undulating progression shaped like a saw tooth or like an open broken line as for example represented in FIGS. 11, 12A and 12B of frequency and amplitude that can be predetermined. It should be specified that in FIGS. 12A and 12B the plane P on which the closure panel 16 lies has slope opposite with respect to that of the closure panel 16 of FIG. 11A.

The operation of the apparatus 10 according to the present invention is as follows.

Figure 1A:
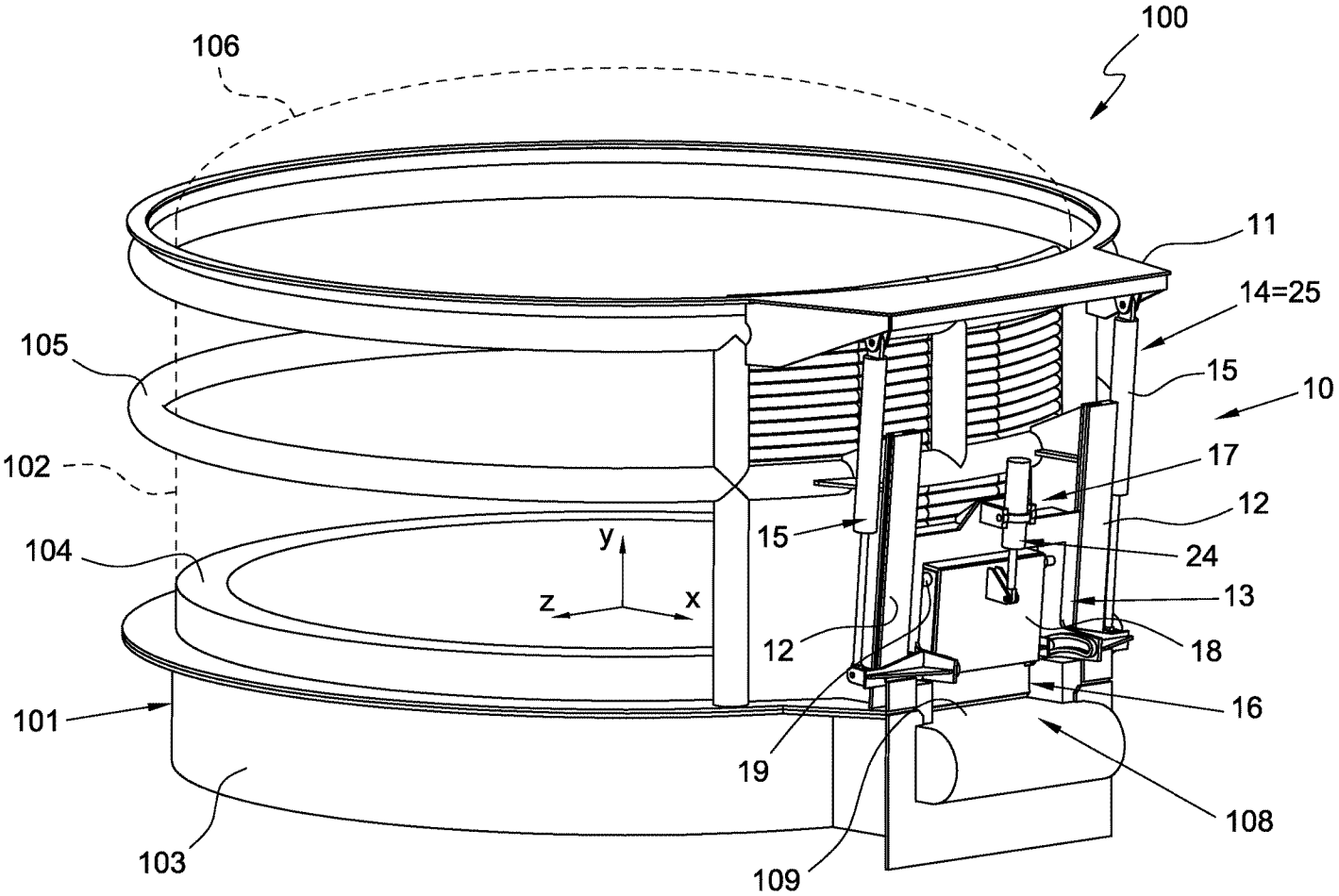
FIGS. 1A and 1B are schematic and axonometric views of a closing and cleaning apparatus according to the present invention applied to a metallurgical furnace respectively in closure position and in opening position of the slag doorway.
Figure 8:
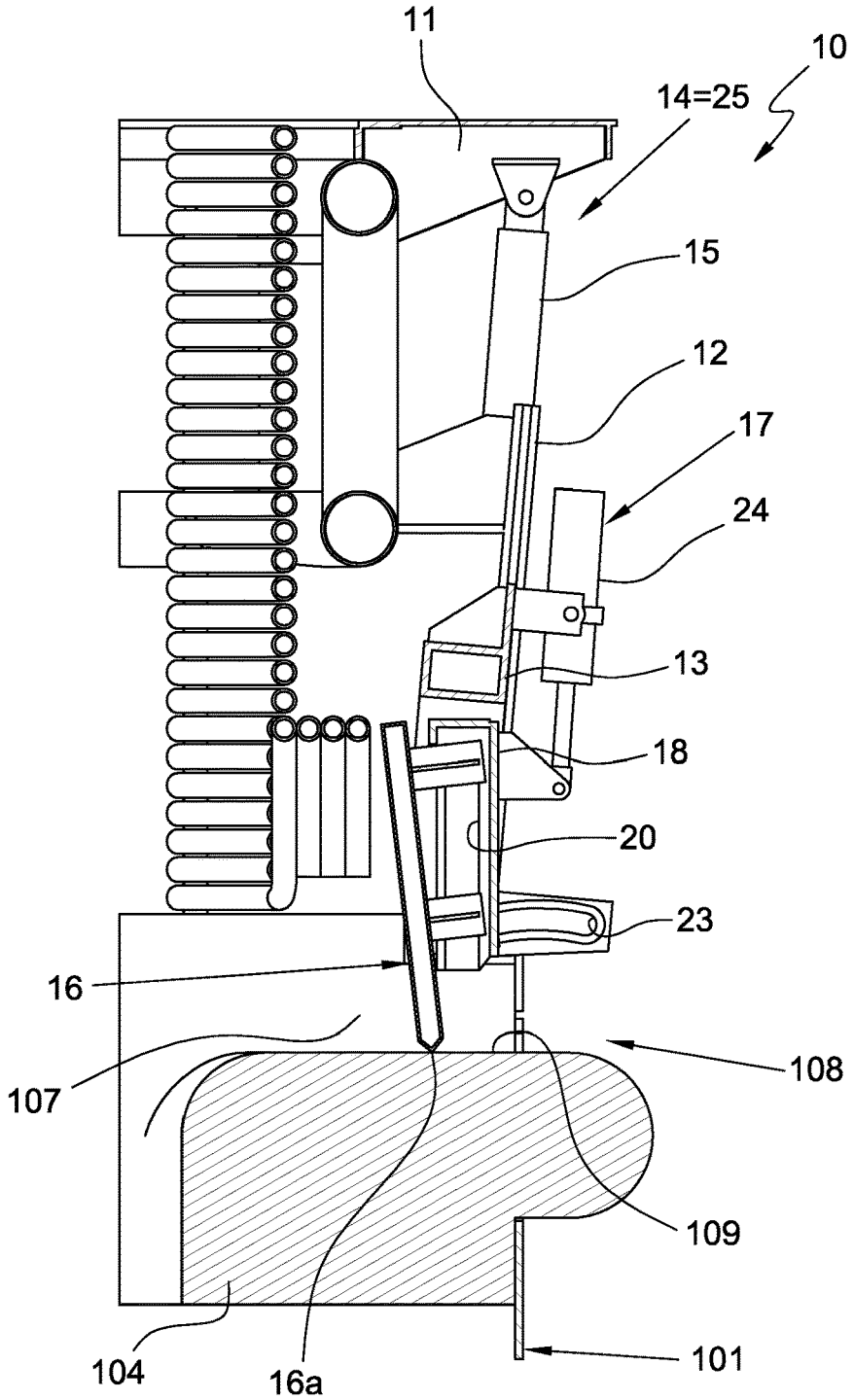
FIG. 8 is a schematic and partial section view of the closing and cleaning apparatus according to the present invention applied to a metallurgical furnace in closure position of the slag doorway.

During the working of the furnace 100 and, in particular, during the loading operations of the material to be melted and the melting of the latter, the slag doorway is closed by the closure panel 16 kept in its closure position so as to block the opening 107 (FIGS. 1A and 8).

Figure 1B:
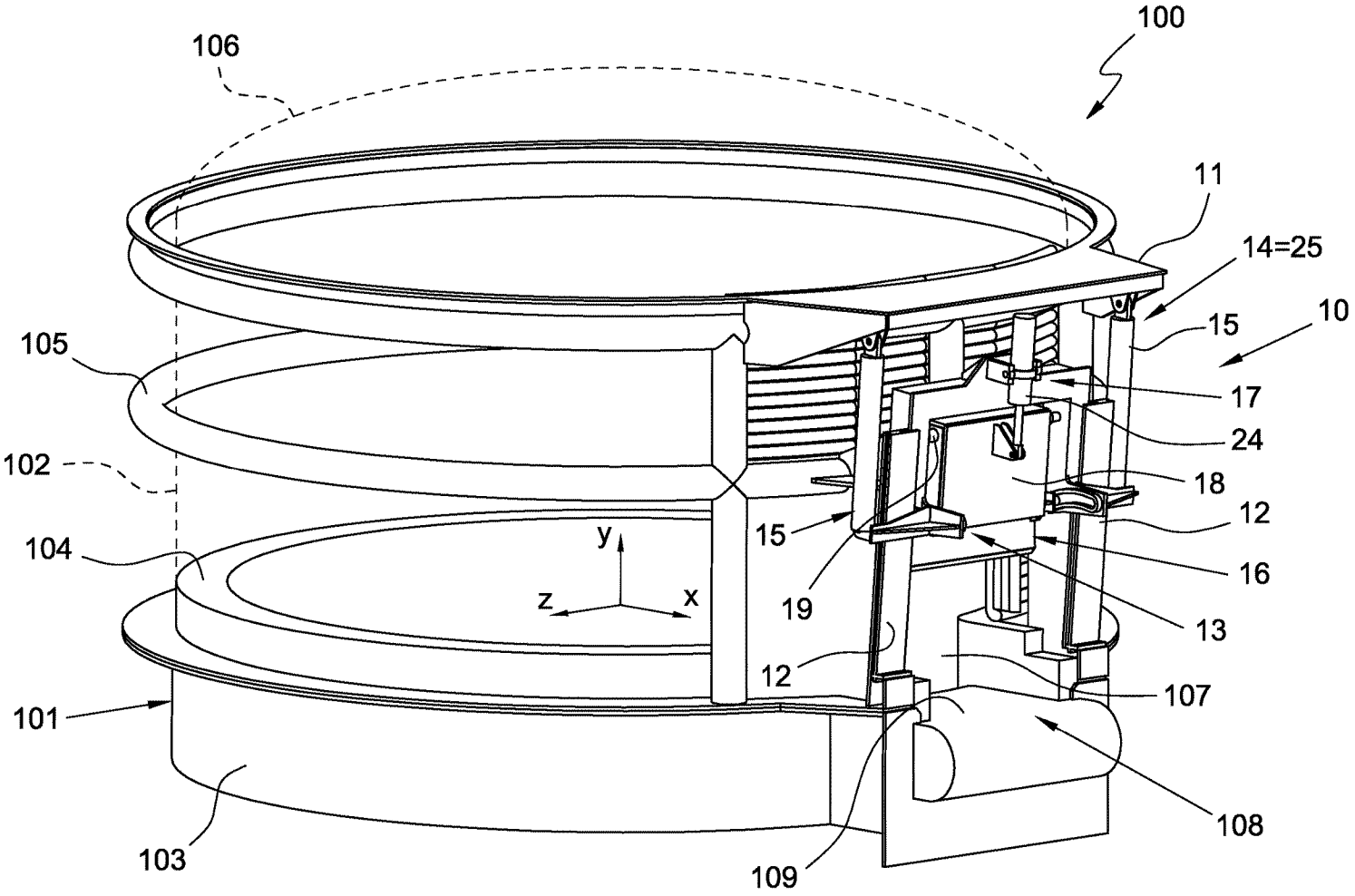
Figure 2:
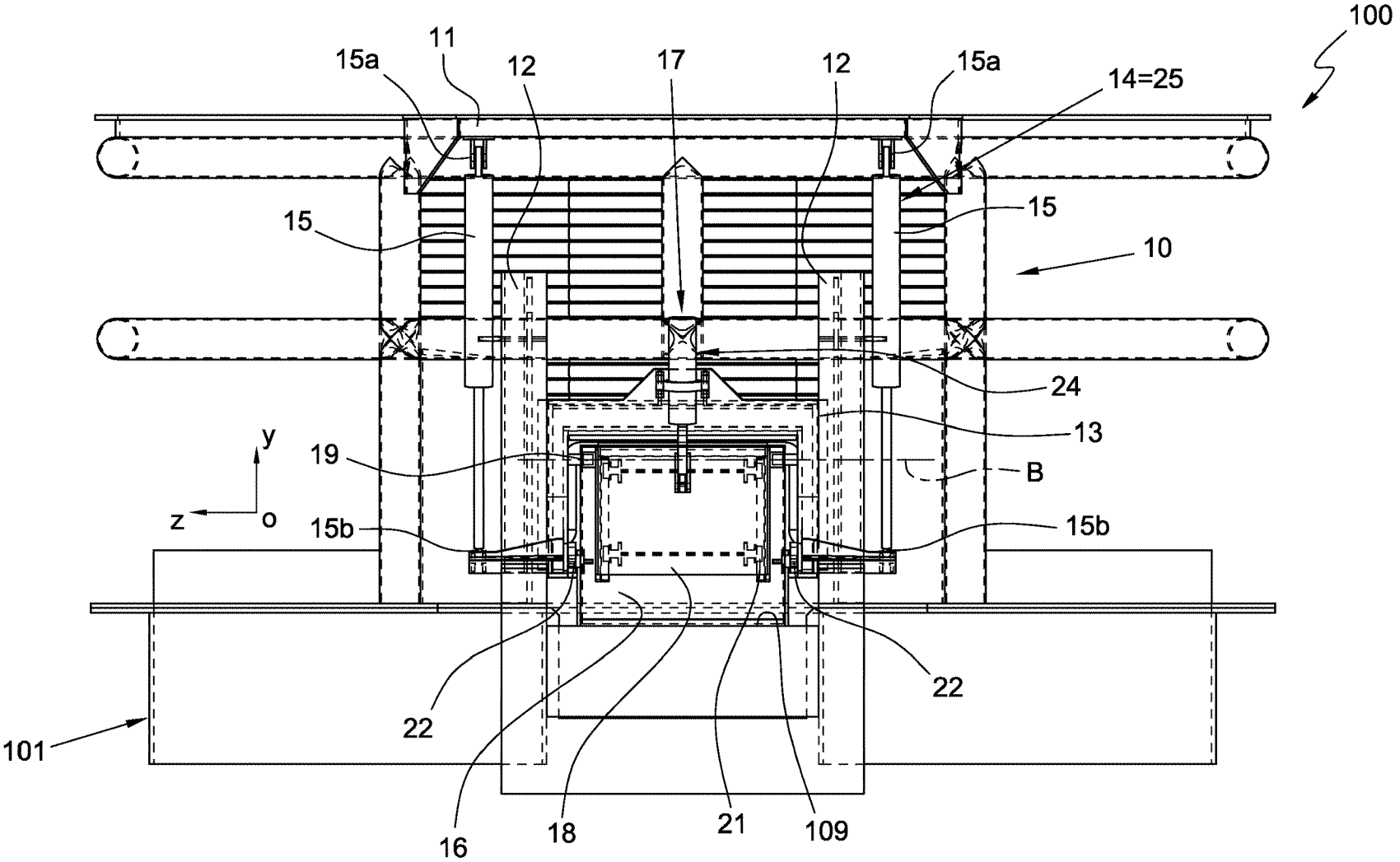
FIG. 2 is a schematic front view of FIG. 1A.
Figure 3:
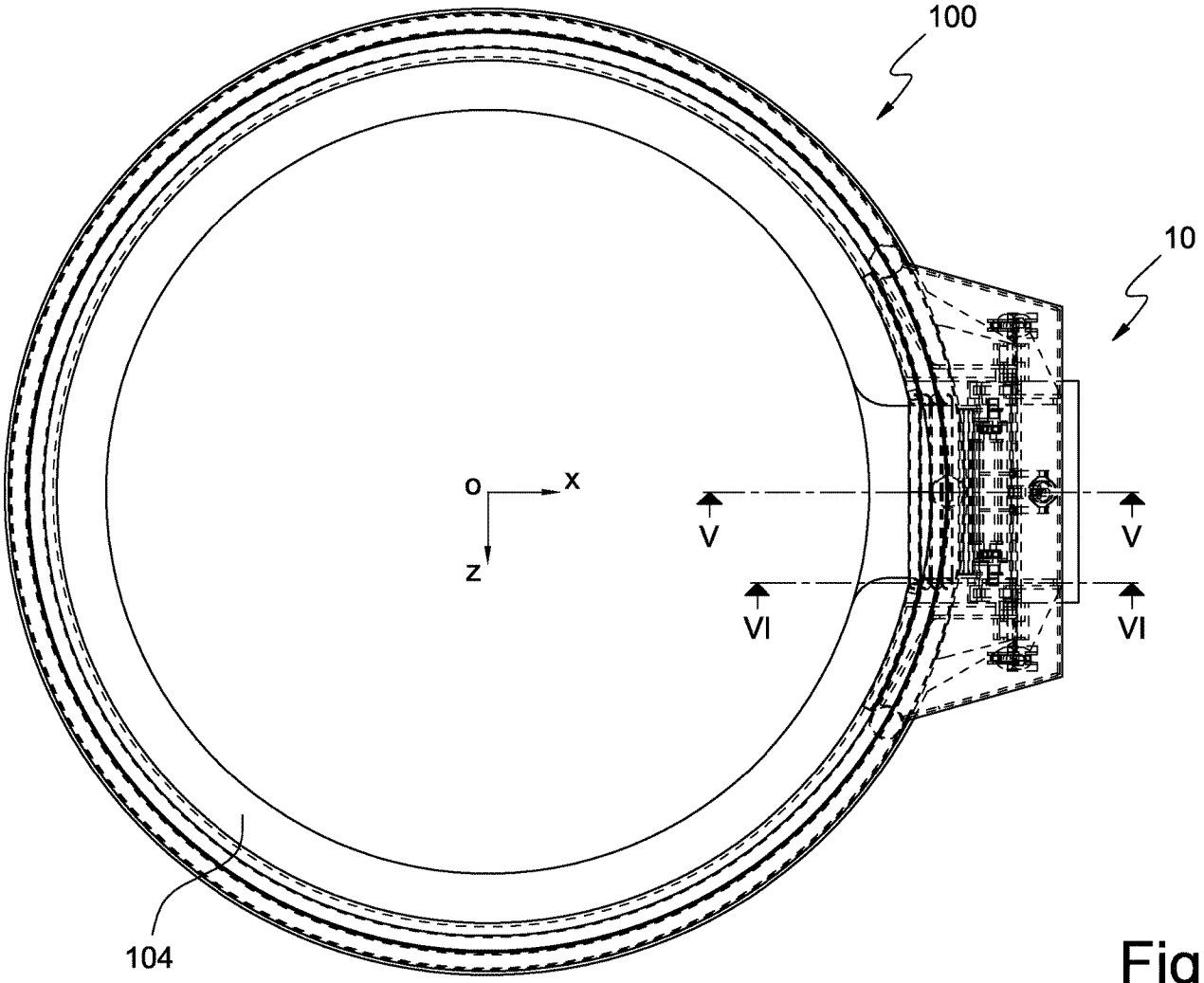
FIG. 3 is a schematic plan view from the above of FIG. 1A.
Figure 4:
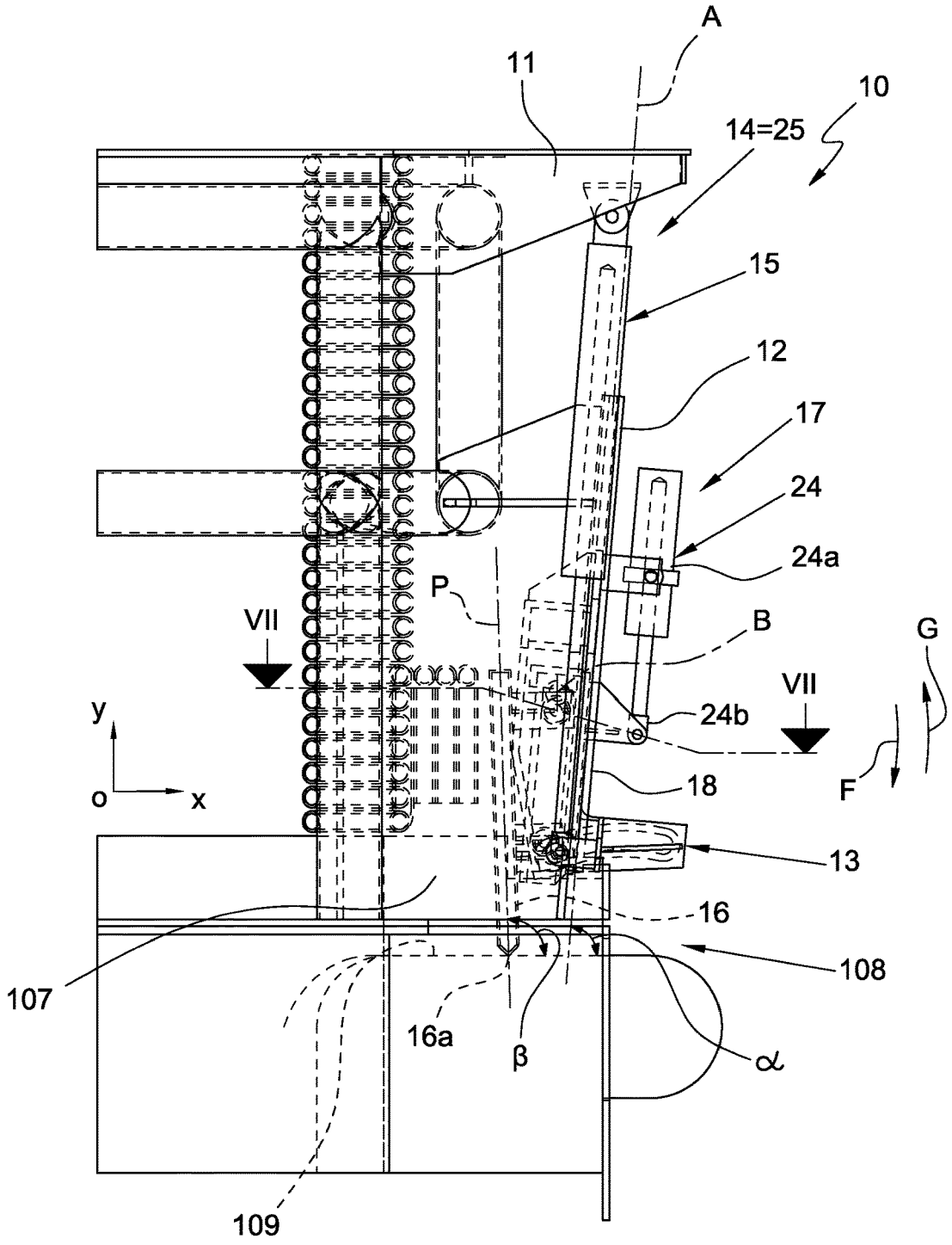
FIG. 4 is a schematic side elevation view of FIG. 3.
Figure 5:
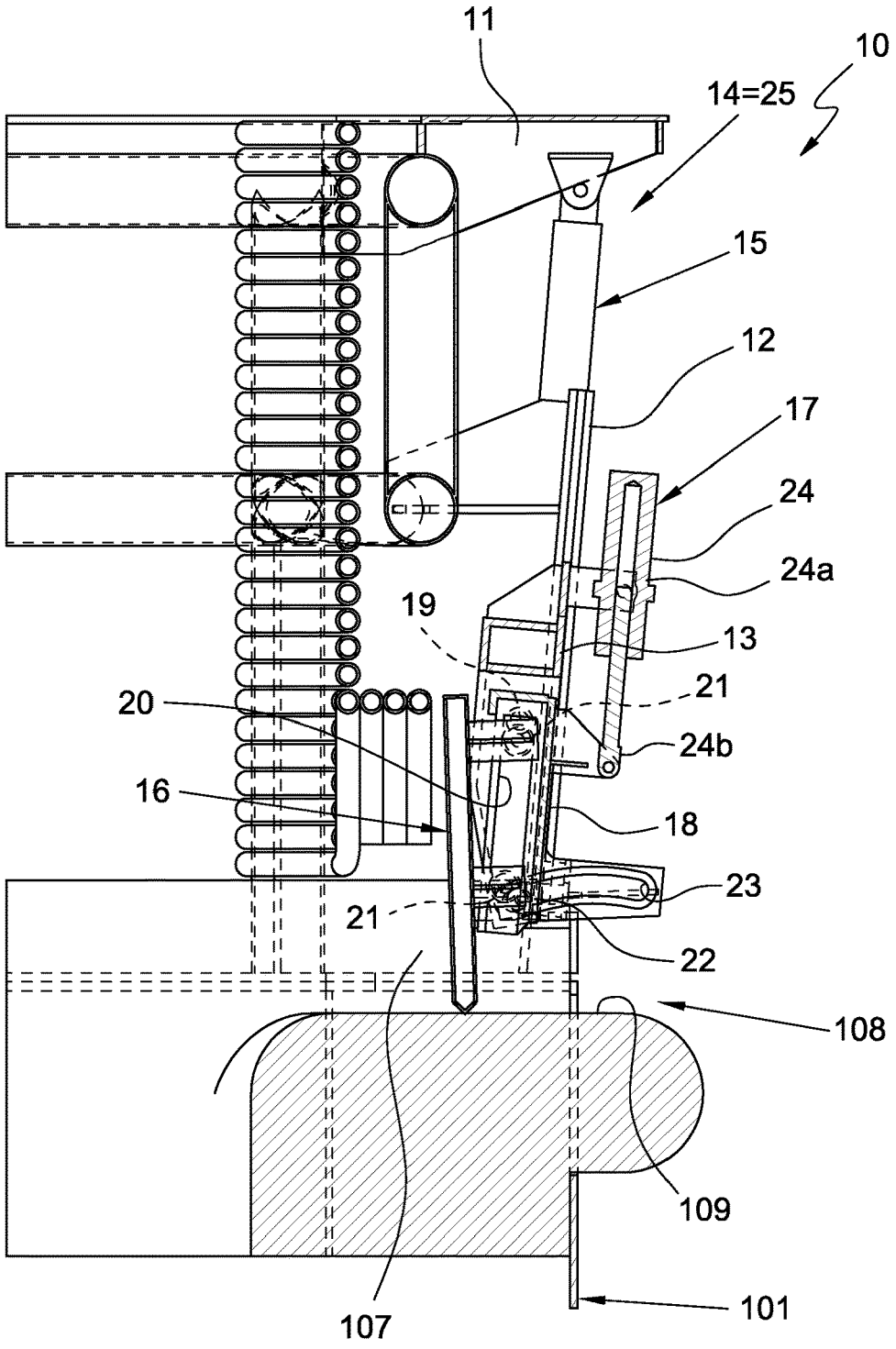
FIG. 5 is a schematic section according to the plane V-V of FIG. 3.
Figure 6:
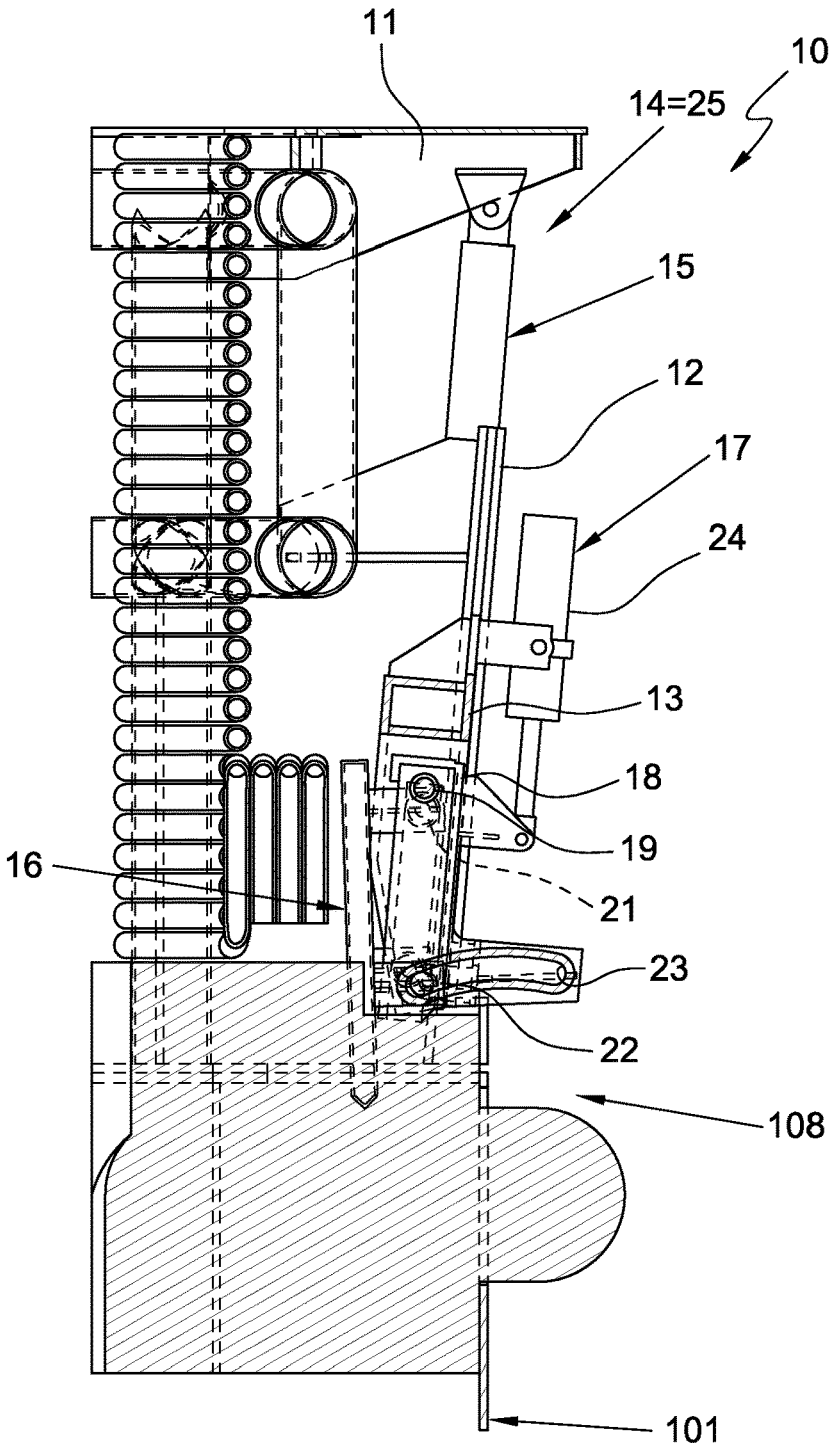
FIG. 6 is a schematic section according to the plane VI-VI of FIG. 3.
Figure 7:
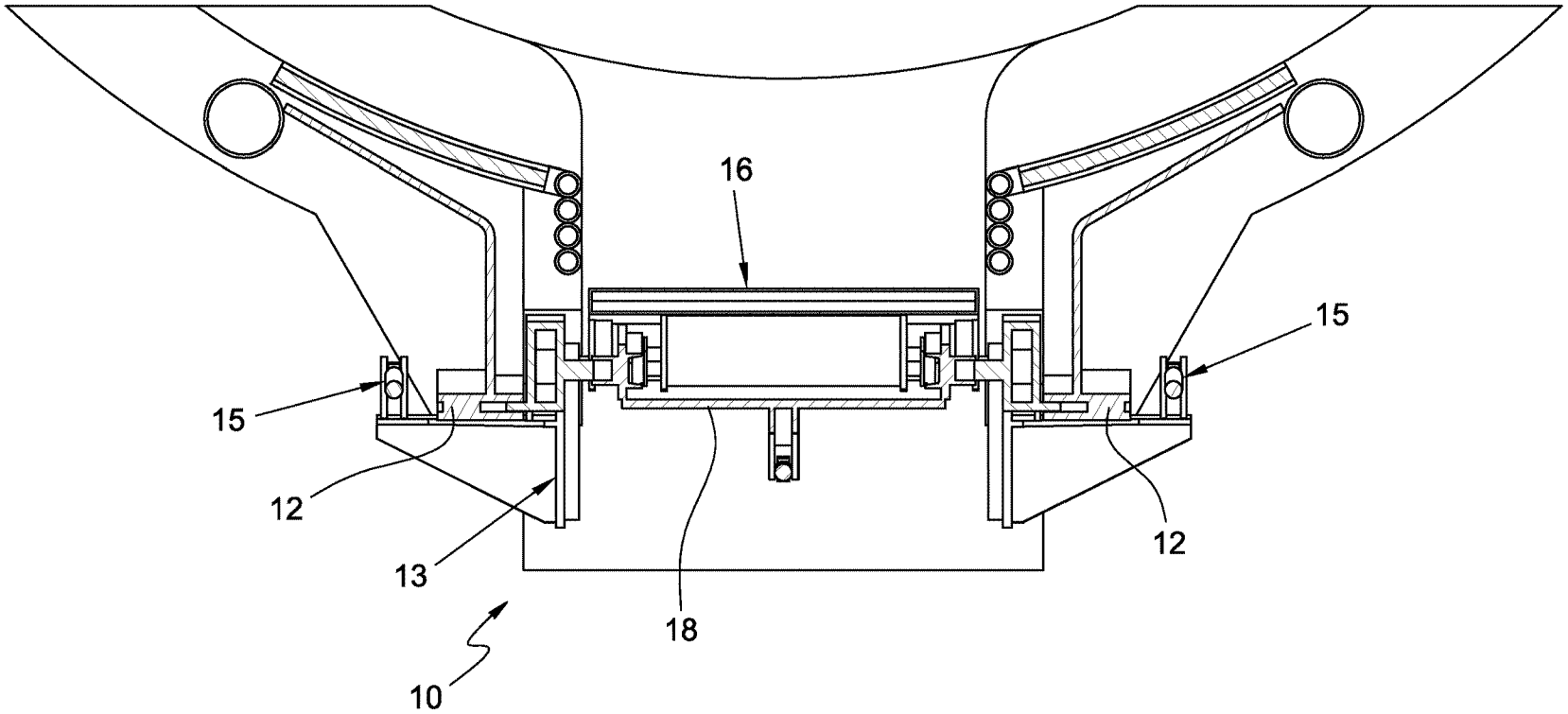
FIG. 7 is a schematic section according to the plane VII-VII of FIG. 4.
Figure 9:
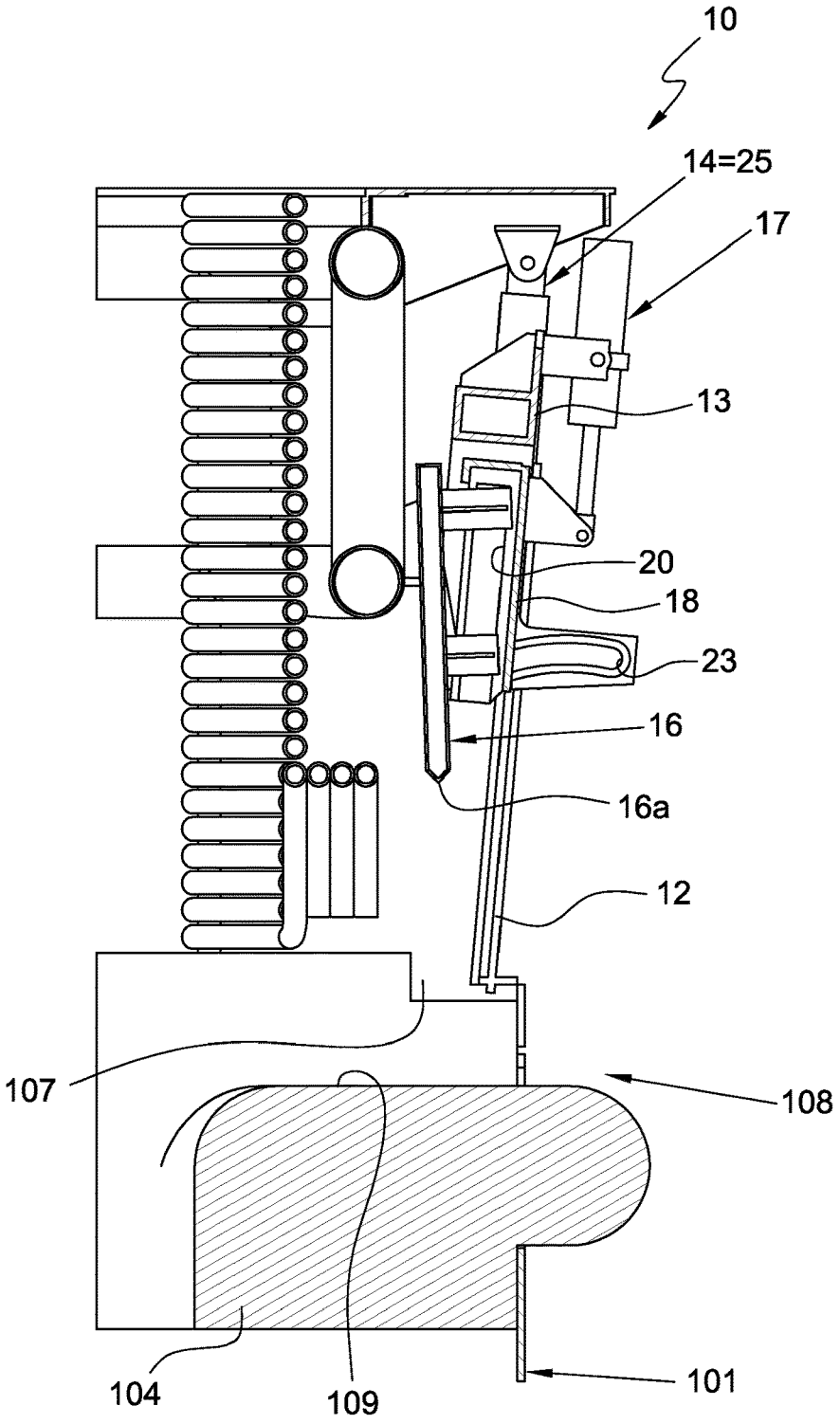
FIG. 9 is a schematic and partial section view of the closing and cleaning apparatus according to the present invention applied to a metallurgical furnace in opening position of the slag doorway.

If it becomes necessary to open the slag doorway, for example for the slagging operation or for the addition of additives through lances or for inspections, the first actuator means 14 are controlled and activated to move the closure panel 16 from its closure position to the open position in which it frees the opening 107 (FIGS. 1B and 9).

In the embodiment represented in the attached figures, the stem of the first hydraulic cylinders 15 is retracted inside the respective cylinder to make the slide means 13, and the closure panel 16 with them, slide along the rectilinear guides 12 to raise it away from the threshold of the slag doorway, or rather from the bottom 109.

The opposite takes place to close the slag doorway.

It should be noted that, thanks to the inclination with negative gradient of the plane P on which the closure panel 16 lies, possible incrustations of material present on its face facing the inside of the furnace 100 do not hinder the sliding movement of the closure panel 16 itself, making the use of special scrapers fixed to the support structure 11 superfluous.

During the sliding of the closure panel 16 to open or close the slag doorway, the second actuator means 17 are deactivated, so that the closure panel 16 and, with it, the articulation body 18 and the same second actuator means 17, form a rigid body with the slide means 13.

If it becomes necessary to remove material that has accumulated or incrusted on the threshold of the slag doorway or on the bottom 109 of the slag channel 108—like, for example, at the end of a melting cycle—the closure panel 16 is moved, from its closure position or in any case from its first position, away from the slag doorway towards the outside of the furnace 100 so that its lower border 16*a* (slag-breaking body) wipes the threshold of the slag doorway and/or the bottom 109 of the slag channel 108 keeping itself parallel to the bottom 109 itself.

Figure 10C:
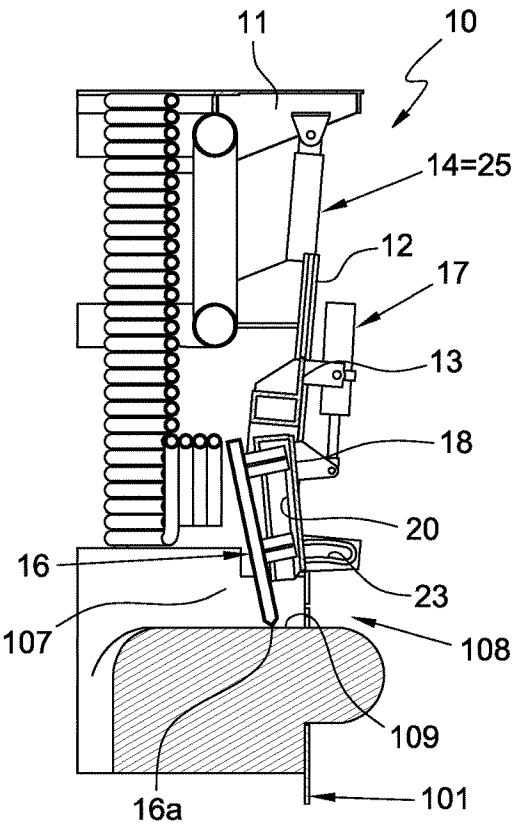
Figure 10B:
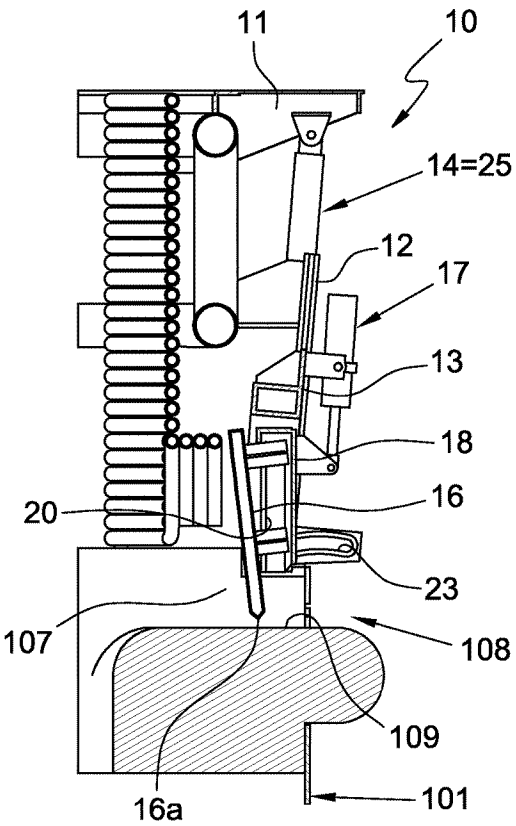
Figure 10A:
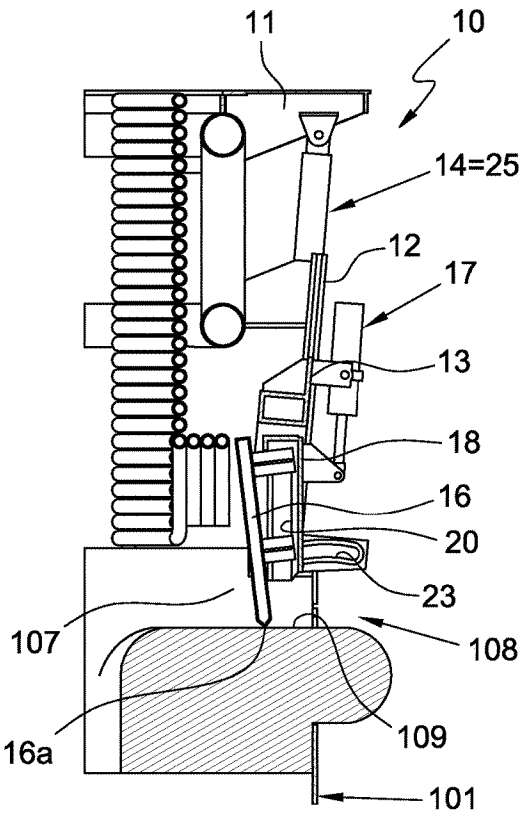
Figure 10E:
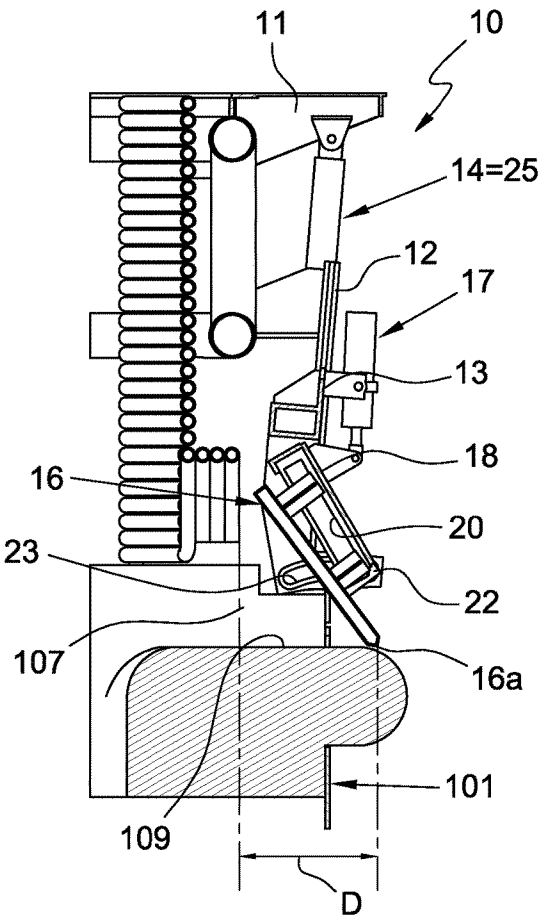
Figure 10D:
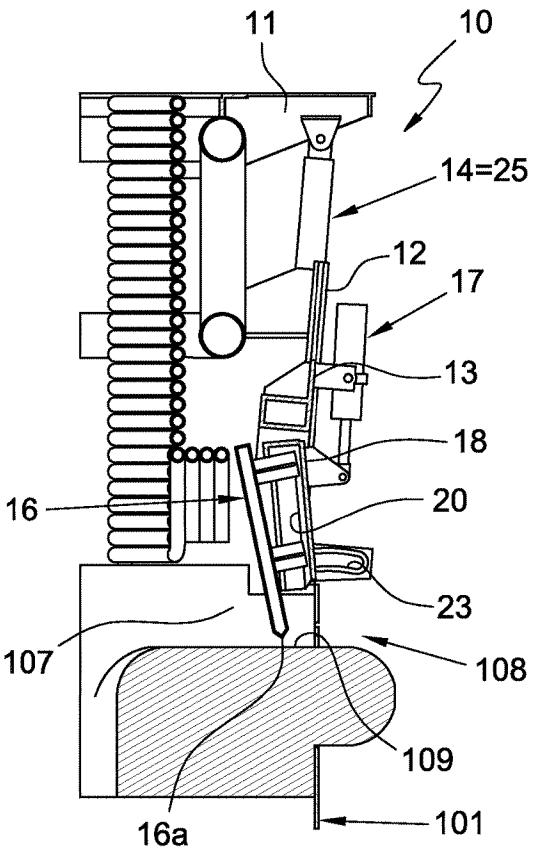

For this purpose, the second actuator means 17 are activated to move the closure panel 16 from its first position towards its second position (FIGS. 10A and 10E).

It should be specified that, through the first actuator means 14, the closure panel 16 could start its stroke away from the slag doorway from an intermediate position between the closed one and open one, in which its lower border 16*a* (slag-breaking body) is raised to a non null height with respect to the bottom 109 so as to wipe a layer of material accumulated or incrusted on the bottom 109, in particular, if the latter is particularly thick.

It should also be specified that the closure panel could initially be brought, through the first actuator means 14 and the second actuator means 17, to its second position, and from here be brought towards the slag doorway, or to a position intermediate to them, and from here be moved away from or towards the slag doorway.

During the movement of the closure panel 16 away from (or towards) the slag doorway its lower border 16*a* (slag-breaking body) is kept parallel to the bottom 109 and, in particular, follows, for at least one tract of its travel, a trajectory parallel to the longitudinal axis of the bottom 109 that, in the case represented, is rectilinear.

During at least one portion of such a trajectory, the vibrating or oscillating means 25 are activated so as to impart on the closure panel 16 a vibrating or oscillating movement with non null component incident the bottom 109.

In this case the lower border 16*a* of the closure panel 16 follows an undulating trajectory (FIGS. 11, 12A and 12B) and exerts on the material present on the bottom 109 a hammering action such as to break it and crush it or at least weaken it promoting its removal.

The closure panel 16, or rather its lower border 16*a*, thus acts as a slag-breaking body.

The removal of the material thus weakened and crushed can take place at the same time as the weakening and crushing step or in a subsequent step, carried out by a removing body that, in the embodiment, coincides with the same closure panel 16 that is moved from its first position to its second position, or vice-versa, so that its lower border 16*a* wipes the bottom 109 or a plane parallel to it. During such a subsequent removal step, the vibrating or oscillating means 25 are inactive.

Preferably, the removal of the material takes place by moving the closure panel 16, or else the removing body, from its first position to its second position, i.e. from the inside towards the outside of the furnace 100, in order to prevent possible fragments of refractory material from being introduced into the melting bath.

Such a cleaning cycle can also be carried out even only a tract of the slag channel 108 and can be repeated many times with the closure panel 16 (slag-breaking body) at the same or at different heights so as to remove subsequent levels of the layer of material accumulated or incrusted on the bottom 109 and reduce the risk of breaking of the refractory material that coats the latter.

At the end of a cleaning cycle, the closure panel 16 is brought to its closure position or to its opening position.

According to the present invention, therefore, the cleaning of the slag channel 108 that crosses the slag doorway of a metallurgical furnace and that has a bottom 109 on which there is at least one layer of material to be removed comprises the steps consisting of:

a) moving a slag-breaking body, which is provided with a lower border that is directed towards the bottom 109 of the slag channel 108 and that is placed at a definable height with respect to it, along the slag channel 108 itself away from or towards the slag doorway, b) weakening or crushing the layer of material to be removed present on the bottom 109 by imparting to such a slag-breaking body a vibrating or oscillating movement with non null component incident the bottom 109, during at least one portion of the travel of the slag-breaking body away from or towards the slag doorway, c) removing the material to be removed so weakened or crushed.

Such a removal step c) can be contextual or deferred with respect to the weakening or crushing step b) of the material present on the bottom 109.

In the case in which the removal step c) is contextual to the weakening or crushing step b), it is the same slag-breaking body that, during its movement away from or towards the slag doorway, wipes the material so weakened or crushed.

In the case in which the removal step c) is deferred with respect to the weakening or crushing step b), it takes place by moving a removing body, also provided with a border that is directed towards the bottom 109 of the slag channel 108 and that is placed at a definable height with respect to it, along the slag channel 108 itself away from or towards the slag doorway in order to wipe its bottom 109.

Advantageously, the removing body coincides with the slag-breaking body and the latter coincides with the closure panel of the slag doorway, the latter advantageously consisting of a unique body the surface extension of which is such as to completely block the slag doorway.

Steps a) to c) can be repeated more than once with the slag-breaking body arranged with its lower border at the same or at different heights with respect to the bottom 109 to remove successive levels of the material layer present on the bottom 109 and to be removed or to carry out accurate cleaning, without risks of breaking the refractory material that coats the bottom 109 itself.

The closing and cleaning apparatus object of the present invention has the advantage of allowing, with a single closure panel, the complete closure of the slag doorway and accurate cleaning of the threshold and of the slag channel.

In particular, the closing and cleaning apparatus object of the present invention, thanks to the weakening and crushing of the material to be removed obtained thanks to the vibrating or oscillating movement imparted on the closure panel itself, makes it possible to effectively remove such material without it being necessary to exert on it high tangential forces.

On the one hand, this means less risk of breaking the refractory material that coats the threshold and the bottom of the slag channel, with consequent reduction of the relative interventions for maintenance or remake and, on the other hand, a lightening and a simplification of the structure of the apparatus itself with respect to the known ones, as well as the use of lower power actuators, with the great benefit of a saving of energy and costs.

The closing and cleaning apparatus of the slag doorway and channel of a metallurgical furnace and the relative method thus conceived can undergo numerous modifications and variants, all of which are covered by the invention; moreover, all of the details can be replaced by technically equivalent elements. In practice, the materials used, as well as the sizes, can be whatever according to the technical requirements.

The invention claimed is:

1. An apparatus for closing a slag doorway and for cleaning the slag doorway and channel of a metallurgical furnace including walls, wherein a slag doorway is defined and a slag channel which crosses the slag doorway and has a bottom, the apparatus comprising:

a support structure associable with the furnace;

at least one slag-breaking body including a lower border which, under mounting conditions of the apparatus on the furnace, is directed towards the bottom and at a definable height with respect to it, wherein the slag-breaking body is associated with the support structure, and is movable along the slag channel away from and/or towards the slag doorway to wipe, through its lower border, the bottom or a plane parallel to it; and a vibrating or oscillating actuator to confer to the slag-breaking body, a vibrating or oscillating movement having a non null component incident the bottom, during at least one tract of travel performed by the slag-breaking body during movement of the slag-breaking body away from or towards the slag doorway, wherein the vibrating or oscillating movement is separate from the movement of the slag-breaking body away from or towards the slag doorway.

2. The closing and cleaning apparatus according to claim 1, wherein the slag-breaking body is associated with the support structure, and is movable along a direction incident the bottom to adjust a height of a lower border of the slag-breaking body with respect to the bottom.

3. The closing and cleaning apparatus according to claim 1, wherein during movement of the slag-breaking body away from and/or towards with respect to the slag doorway, its lower border follows, for at least one tract of its travel, a trajectory incident the plane defined by the slag doorway and parallel to the bottom.

4. The closing and cleaning apparatus according to claim 1, further comprising a removing body of material present on the bottom which includes a lower border which, under mounting conditions of the apparatus on the furnace, is directed towards the bottom and which is placed at a definable height with respect to it, the removing body being associated with the support structure, and is movable along the slag channel away from and/or towards the slag doorway to wipe the bottom or a plane parallel to it.

5. The closing and cleaning apparatus according to claim 4, wherein the removing body coincides with the slag-breaking body.

6. The closing and cleaning apparatus according to claim 1, further comprising at least one closure panel of the slag doorway associated with the support structure, and is movable between a closure position of the slag doorway and an opening position of the slag doorway and vice versa, and which includes a lower border which, under mounting conditions of the apparatus on the furnace, is directed towards the bottom.

7. The closing and cleaning apparatus according to claim 6, further comprising a unique closure panel with a surface extension equal to or greater than that of the slag doorway.

8. The closing and cleaning apparatus according to claim 6, wherein the slag-breaking body coincides with the closure panel, the closure panel being associated with the support structure, and is movable both between the closure position of the slag doorway and the opening position of the slag doorway and vice versa, and away from the slag doorway towards an outside of the furnace and vice versa towards the slag doorway from the outside of the furnace, to wipe through its lower border the bottom or a plane parallel to it, wherein the vibrating or oscillating actuator is associated with the closure panel to confer it a vibrating or oscillating movement having a non null component incident the bottom, during at least one tract of the travel performed during its movement away from or towards the slag doorway.

9. The closing and cleaning apparatus according to claim 6, further comprising:

a rectilinear guide associated with the support structure and which extends along a direction incident the bottom;

a slide that slides along the rectilinear guide; and a first actuator that slides the slide along the rectilinear guide, wherein the closure panel is associated with the slide integrally in translation with it to be moved, under mounting conditions of the apparatus on the furnace, between the closure position, wherein it is lowered with respect to the bottom with the lower border substantially in contact with it, and the opening position, wherein it is raised with respect to the bottom, passing through a plurality of intermediate positions.

10. The closing and cleaning apparatus according to claim 9, wherein the direction is inclined with positive gradient of an angle with respect to the bottom.

11. The closing and cleaning apparatus according to claim 9, wherein the closure panel is associated with the slide, and is movable away from the slag doorway towards an outside of the furnace and vice versa towards the slag doorway from the outside of the furnace to wipe through the lower border the bottom or a plane parallel to it; and further comprising a second actuator of that moves the closure panel away from and towards the slag doorway and which are supported by the slide.

12. The closing and cleaning apparatus according to claim 11, wherein the closure panel is associated with the slide, and is movable between a first position, wherein its lower border is at or in proximity of the slag doorway, and a second position, wherein its lower border is distanced from the slag doorway by a definable distance towards the outside of the furnace, and vice versa, passing through a plurality of intermediate positions, wherein its lower border follows, for at least one tract of its travel, a trajectory incident the plane defined by the slag doorway and parallel to the bottom.

13. The closing and cleaning apparatus according to claim 11, further comprising:

an articulation body which is articulated to the slide to be rotatable around an axis parallel to the bottom and to the plane of the slag doorway;

the rectilinear guide which is defined in the articulation body and which is incident the bottom and orthogonal to the axis and shaped guides defined in the slide, wherein the closure panel slidingly couples respectively with the rectilinear guides and with the shaped guide, and wherein the second actuator is mounted on the slide to move the articulation body in rotation around the axis.

14. The closing and cleaning apparatus according to claim 9, wherein the vibrating or oscillating actuator comprises the first actuator which is actuated by an operating and control system to impose to the slide, and to the closure panel integral in translation with them, an alternate movement having determined and modifiable frequency and magnitude.

15. The closing and cleaning apparatus according to claim 6, wherein the closure panel lies on a plane which is inclined with negative gradient by an angle with respect to the bottom.

16. A metallurgical furnace, or electric arc furnace for steelmaking, comprising:

a shell in walls of which at least one slag doorway is obtained and a slag channel that crosses the slag doorway and that has a bottom, the metallurgical furnace comprising an apparatus for closing the slag doorway and for cleaning the slag doorway and the slag channel comprising:

a support structure associable with the metallurgical furnace;

at least one slag-breaking body including a lower border which, under mounting conditions of the apparatus on the metallurgical furnace, is directed towards the bottom and at a definable height with respect to it, wherein the slag-breaking body is associated with the support structure, and is movable along the slag channel away from and/or towards the slag doorway to wipe, through its lower border, the bottom or a plane parallel to it; and a vibrating or oscillating actuator to confer to the slag-breaking body, a vibrating or oscillating movement having a non null component incident the bottom, during at least one tract of travel performed by the slag-breaking body during movement of the slag-breaking body away from or towards the slag doorway, wherein the vibrating or oscillating movement is separate from the movement of the slag-breaking body away from or towards the slag doorway.

17. A method for cleaning a slag channel which crosses a slag doorway of a metallurgical furnace and which has a bottom whereon at least one layer of material to be removed is present, comprising:

a) moving a slag-breaking body, which includes a lower border which is directed towards the bottom and which is placed at a definable height with respect to it, along the slag channel away from or towards the slag doorway;

b) weakening or crushing a layer of material to be removed by conferring to the slag-breaking body a vibrating or oscillating movement having a non null component incident the bottom, during at least one portion of travel of the slag-breaking body away from or towards the slag doorway, wherein the vibrating or oscillating movement is separate from the travel of the slag-breaking body away from or towards the slag doorway; and c) removing the material to be removed so weakened or crushed.

18. The cleaning method according to claim 17, wherein the removing c) is contextual or deferred with respect to the weakening or crushing b).

19. The cleaning method according to claim 17, wherein the removing c) is contextual to the weakening or crushing b), and wherein the slag-breaking body wipes the material so weakened or crushed during its movement away from or towards the slag doorway.

20. The cleaning method according to claim 17, wherein the removing c) is differed with respect to the weakening or crushing b) and occurs making a removing body move, removing body which includes a border directed towards the bottom and placed at a definable height with respect to it along the slag channel itself away from or towards the slag doorway to wipe its bottom.

21. The cleaning method according to claim 20, wherein the removing body coincides with the slag-breaking body.

22. The cleaning method according to claim 17, wherein the slag-breaking body is made of a closure panel of the slag doorway.

23. The cleaning method according to claim 17, wherein a) to c) are repeated more than once with the slag-breaking body placed with its lower border at a same or at different height with respect to the bottom.

* * * * *